US005608423A

United States Patent [19]

Leach

[11] Patent Number: 5,608,423

[45] Date of Patent: Mar. 4, 1997

[54] VIDEO DISPLAY PROCESSOR WITH PIXEL BY PIXEL HARDWARE SCROLLING

[75] Inventor: Jerald G. Leach, Houston, Tex.

[73] Assignee: Texas Instruments Incorporated, Dallas, Tex.

[21] Appl. No.: 488,388

[22] Filed: Jun. 7, 1995

Related U.S. Application Data

[63] Continuation of Ser. No. 103,498, Aug. 6, 1993, Pat. No. 5,552,804, which is a continuation of Ser. No. 102,873, Aug. 6, 1993, which is a continuation of Ser. No. 803,236, Dec. 5, 1991, Pat. No. 5,379,049, which is a continuation of Ser. No. 455,869, Dec. 18, 1989, Pat. No. 5,089,811, which is a continuation of Ser. No. 262,176, Oct. 20, 1988, abandoned, which is a continuation of Ser. No. 38,476, Apr. 13, 1987, abandoned, which is a continuation of Ser. No. 600,921, Apr. 16, 1984, abandoned.

[51] Int. Cl.[6] ..... G09G 5/34

[52] U.S. Cl. ..... 345/123; 345/133; 345/150

[58] Field of Search ..... 345/114, 122, 345/199, 150, 113, 121, 133, 123

[56] References Cited

U.S. PATENT DOCUMENTS 4,232,311 11/1980 Agneta ..... 345/22
4,524,421 6/1985 Searby et al. ..... 345/150
5,089,811 2/1992 Leach ..... 345/199
5,379,049 1/1995 Leach ..... 345/22

*Primary Examiner*—Mark R. Powell
*Assistant Examiner*—Matthew Luu
*Attorney, Agent, or Firm*—Robert D. Marshall, Jr.; James C. Kesterson; Richard L. Donaldson

[57] ABSTRACT

A video display processor and system supports hardware scrolling of the display. Horizontal and vertical scroll registers control the base address of the memory storing the display data. The horizontal scroll register resets a horizontal state register at the beginning of each horizontal line of a raster scan display. The horizontal state register counts for each pixel of the horizontal line. The vertical scroll register resets a vertical state register at the beginning of each screen of the display. The vertical state register counts for each line. Addressing logic uses the horizontal state register and the vertical state register for recalling display data from memory. This recalled display data controls the contents of a video display. The display may be scrolled horizontally or vertically by a host processor writing into the scroll registers. A display priority logic and sprite registers permits mobile sprites to be overlain upon the base display.

15 Claims, 15 Drawing Sheets

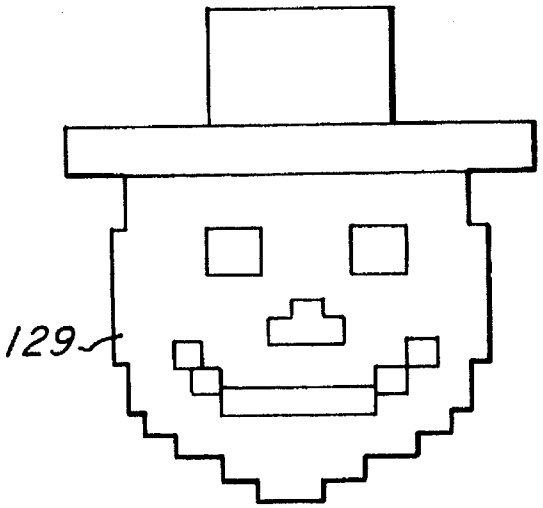
Fig. 5c
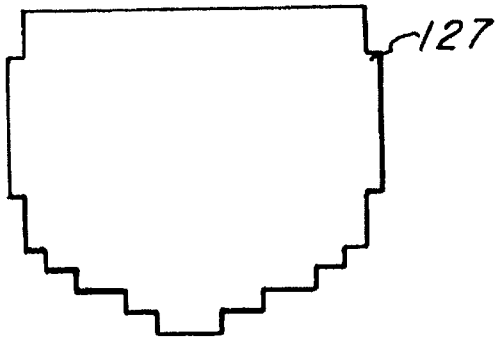
Fig. 5b
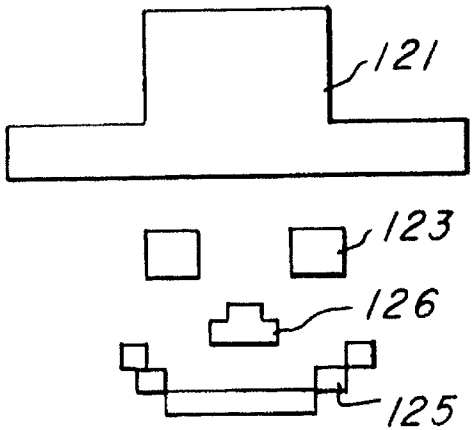
Fig. 5a
| 0 | 1 | 2 | 3 | 4 | 5 | 6 | 7 |
|---|---|---|---|---|---|---|---|
| SPRITE | | GROUPS | | | COLLIDE | | |
Fig. 6

| OPERATION | CPU/AVDP DATA BUS 0 | 1 | 2 | 3 | 4 | 5 | 6 | 7 | $\overline{CSW}$ | $\overline{CSR}$ | MODE |
|---|---|---|---|---|---|---|---|---|---|---|---|
| WRITE TO AVDP REGISTER | | | | | | | | | | | |
| BYTE 1 DATA TRANSFER | D0 | D1 | D2 | D3 | D4 | D5 | D6 | D7 | 0 | 1 | 1 |
| BYTE 2 REGISTER SELECT | 1 | 0 | RS0 | RS1 | RS2 | RS3 | RS4 | RS5** | 0 | 1 | 1 |
| READ STATUS REGISTER | | | | | | | | | | | |
| BYTE 1 DATA READ | D0 | D1 | D2 | D3 | D4 | D5 | D6 | D7 | 1 | 0 | 1 |
| READ SPRITE COLLISION REGISTER | | | | | | | | | | | |
| BYTE 1 NO OPERATION | × | × | × | × | × | × | × | × | 0 | 1 | 1 |
| BYTE 2 REGISTER SELECT | 1 | 1 | 0 | 0 | 0 | 0 | 0 | 1 | 0 | 1 | 1 |
| BYTE 3 DATA READ | D0 | D1 | D2 | D3 | D4 | D5 | D6 | D7 | 1 | 0 | 0 |
| WRITE TO VIDEO RAM | | | | | | | | | | | |
| BYTE 1 LOW ADDRESS SET | A6 | A7 | A8 | | A9 | A10 | A11 | A12 | A13 | 0 | 1 | 1 |
| BYTE 2 HIGH ADDRESS SET | 0 | 1 | A0 | A1 | A2 | A3 | A4 | A5 | 0 | 1 | 1 |
| BYTE 3 DATA WRITE | D0 | D1 | D2 | D3 | D4 | D5 | D6 | D7 | 0 | 1 | 0 |
| READ FROM VIDEO RAM | | | | | | | | | | | |
| BYTE 1 LOW ADDRESS SET | A6 | A7 | A8 | | A9 | A10 | A11 | A12 | A13 | 0 | 1 | 1 |
| BYTE 2 HIGH ADDRESS SET | 0 | 1 | A0 | A1 | A2 | A3 | A4 | A5 | 0 | 1 | 1 |
| BYTE 3 DATA WRITE | D0 | D1 | D2 | D3 | D4 | D5 | D6 | D7 | 1 | 0 | 0 |
| WRITE TO SOUND GENERATOR | | | | | | | | | | | |
| BYTE 1 DATA WRITE | D0 | D1 | D2 | D3 | D4 | D5 | D6 | D7 | 0 | 0 | 1 |

Fig. 9

| REGISTER NUMBER | DESCRIPTION |
|---|---|
| 0 | STATUS REGISTER |
| 1 | SPRITE COLLISION REGISTER |

Fig. 10

| REGISTER NUMBER | DESCRIPTION 19 |
|---|---|
| 0 | CONFIGURATION REGISTER 20 |
| 1 | CONFIGURATION REGISTER 15 |
| 2 | BASE ADDRESS OF NAME TABLE SUB-BLOCK 16 |
| 3 | BASE ADDRESS OF COLOR TABLE SUB-BLOCK (8 LSBs) |
| 4 | BASE ADDRESS OF COLOR TABLE SUB-BLOCK (2 MSBs) & BASE ADDRESS OF PATTERN OR TEXT GENERATOR SUB-BLOCK |
| 5 | BASE ADDRESS OF SPRITE ATTRIBUTE TABLE SUB-BLOCK (8 LSBs) 17 |

Fig. 11a

| | | |
|---|---|---|
| 6 | BASE ADDRESS OF SPRITE ATTRIBUTE TABLE SUB-BLOCK (MSB) & BASE ADDRESS OF SPRITE PATTERN GENERATOR SUB-BLOCK | 17 |
| 7 | COLOR CODE IN TEXT MODE BACKDROP COLOR IN ALL MODES | 30 |
| 8 | HORIZONTAL SCROLLING REGISTER | 25 |
| 9 | VERTICAL SCROLLING REGISTER | 23 |
| 10 | CONFIGURATION REGISTER | 21 |
| 11 | LSB BLOCK MOVE REGISTER | 27 |
| 12 | MSB BLOCK MOVE REGISTER | 29 |
| 13 | PROGRAMMABLE INTERRUPT REGISTER | 9 |
| 14 | LSB FOR READ ADDRESS ON BLOCK MOVE | |
| 15 | MSB FOR READ ADDRESS ON BLOCK MOVE | |
| 16 | CPU ADDRESS PAGE REGISTER | |
| 32 | COLOR PALETTE COLOR 0 RRR0GGG0 | |
| 33 | COLOR PALETTE COLOR 0 0000BBB0 | 2 |
| 34 | COLOR PALLETTE COLOR 1 RRR0GGG0 | |
| 35 | COLOR PALLETTE COLOR 1 0000BBB0 | |
| 36 | COLOR PALLETTE COLOR 2 RRR0GGG0 | |
| 37 | COLOR PALLETTE COLOR 3 0000BBB0 | |

Fig. 11b

| | |
|---|---|
| 38 | COLOR PALETTE COLOR 3 RRR0GGG0 |
| 39 | COLOR PALETTE COLOR 3 0000BBB0 |
| 40 | COLOR PALETTE COLOR 4 RRR0GGG0 |
| 41 | COLOR PALETTE COLOR 4 0000BBB0 |
| 42 | COLOR PALETTE COLOR 5 RRR0GGG0 |
| 43 | COLOR PALETTE COLOR 5 0000BBB0 |
| 44 | COLOR PALETTE COLOR 6 RRR0GGG0 |
| 45 | COLOR PALETTE COLOR 6 0000BBB0 |
| 46 | COLOR PALETTE COLOR 7 RRR0GGG0 |
| 47 | COLOR PALETTE COLOR 7 0000BBB0 |
| 48 | COLOR PALETTE COLOR 8 RRR0GGG0 |
| 49 | COLOR PALETTE COLOR 8 0000BBB0 |
| 50 | COLOR PALETTE COLOR 9 RRR0GGG0 |
| 51 | COLOR PALETTE COLOR 9 0000BBB0 |
| 52 | COLOR PALETTE COLOR 10 RRR0GGG0 |
| 53 | COLOR PALETTE COLOR 10 0000BBB0 |
| 54 | COLOR PALETTE COLOR 11 RRR0GGG0 |
| 55 | COLOR PALETTE COLOR 11 0000BBB0 |

2

Fig. 11c

| | |
|---|---|
| 56 | COLOR PALETTE COLOR 12 RRR0GGG0 |
| 57 | COLOR PALETTE COLOR 12 0000BBB0 |
| 58 | COLOR PALETTE COLOR 13 RRR0GGG0 |
| 59 | COLOR PALETTE COLOR 13 0000BBB0 |
| 60 | COLOR PALETTE COLOR 14 RRR0GGG0 |
| 61 | COLOR PALETTE COLOR 14 0000BBB0 |
| 62 | COLOR PALETTE COLOR 15 RRR0GGG0 |
| 63 | COLOR PALETTE COLOR 15 0000BBB0 |

2

Fig. 11d

MSB D0 LSB D7

| | | | |
|---|---|---|---|
| F | C | 11S | 11 sprite number |

Fig. 12

COLOR DIFFERENCE

| | MSB | | | | | | | LSB |
|---|---|---|---|---|---|---|---|---|
| R32,34,36,38,40 42,44,46,48,50 52,54,56;58,60 62 | R-Y | R-Y | R-Y | 0 | Y | Y | Y | 0 |

Fig. 13a

| | MSB | | | | | | | LSB |
|---|---|---|---|---|---|---|---|---|
| R33,35,37,39,41 43,45,47,49,51 53,55,57,59,61 63 | 0 | 0 | 0 | 0 | B-Y | B-Y | B-Y | 0 |

R-Y Y B-Y

Fig. 13b

RED-GREEN-BLUE

| | MSB | | | | | | | LSB |
|---|---|---|---|---|---|---|---|---|
| R32,34,36,38,40 42,44,46,48,50 52,54,56;58,60 62 | R | R | R | 0 | G | G | G | 0 |

Fig. 14a

| | MSB | | | | | | | LSB |
|---|---|---|---|---|---|---|---|---|
| R33,35,37,39,41 43,45,47,49,51 53,55,57,59,61 63 | 0 | 0 | 0 | 0 | B | B | B | 0 |

R = RED G = GREEN B = BLUE

Fig. 14b

| | DEFAULT VALUE AT RESET | | | | | | | | | COLOR NAME |
|---|---|---|---|---|---|---|---|---|---|---|
| COLOR 0 | 0 | 0 | X | 1 | 1 | X | 0 | X | X | TRANSPARENT |
| COLOR 1 | 0 | 1 | 1 | 0 | 0 | 0 | 1 | 0 | 0 | BLACK |
| COLOR 2 | 0 | 0 | 0 | 1 | 0 | 1 | 0 | 1 | 0 | MEDIUM GREEN |
| COLOR 3 | 0 | 0 | 0 | 1 | 0 | 0 | 0 | 1 | 0 | LIGHT GREEN |
| COLOR 4 | 0 | 1 | 1 | 0 | 1 | 1 | 1 | 1 | 0 | DARK BLUE |
| COLOR 5 | 0 | 1 | 1 | 1 | 0 | 0 | 1 | 1 | 0 | LIGHT BLUE |
| COLOR 6 | 1 | 0 | 1 | 0 | 1 | 1 | 0 | 1 | 1 | DARK RED |
| COLOR 7 | 0 | 0 | 1 | 1 | 0 | 1 | 1 | 0 | 1 | CYAN |
| COLOR 8 | 1 | 1 | 1 | 1 | 0 | 0 | 0 | 1 | 0 | MEDIUM RED |
| COLOR 9 | 1 | 0 | 1 | 1 | 0 | 1 | 0 | 1 | 1 | LIGHT RED |
| COLOR A | 1 | 0 | 0 | 1 | 0 | 1 | 0 | 0 | 0 | DARK YELLOW |
| COLOR B | 1 | 0 | 0 | 1 | 1 | 0 | 0 | 0 | 0 | LIGHT YELLOW |
| COLOR C | 0 | 0 | 0 | 0 | 1 | 1 | 0 | 1 | 0 | DARK GREEN |
| COLOR D | 1 | 1 | 1 | 0 | 1 | 1 | 1 | 1 | 1 | MAGENTA |
| COLOR E | 0 | 1 | 1 | 1 | 0 | 1 | 1 | 0 | 0 | GRAY |
| COLOR F | 0 | 1 | 1 | 1 | 1 | 1 | 1 | 0 | 0 | WHITE |

*Fig. 15*

| INTERRUPT IE SELECTED | STATUS BITS AFFECTED IE | F | PIE |
|---|---|---|---|
| BLOCK MOVE | ENABLES INTERRUPT | SET TO 1 ON BLOCK MOVE COMPLETE | DISABLED |
| VERTICAL RETRACE | ENABLES INTERRUPT | SET TO 1 ON VERTICAL RETRACE | NOT AFFECTED |
| PROGRAMMABLE INTERRUPT | ENABLES INTERRUPT | SET TO 1 ON ON SELECTED HORIZONTAL LINE | ENABLES INTERRUPT |
| BLOCK MOVE & VERTICAL RETRACE | ENABLES INTERRUPT | SET TO 1 ON VERTICAL RETRACE AND BLOCK MOVE COMPLETE | DISABLED DURING BLOCK MOVE |

Fig. 16

VIDEO DISPLAY PROCESSOR WITH PIXEL BY PIXEL HARDWARE SCROLLING

This application is a continuation of application Ser. No. 08/103,498 filed Aug. 6, 1993 now U.S. Pat. No. 5,552,804, which is a continuation of application Ser. No. 08/102,873 filed Aug. 6, 1993, which is a continuation of application Ser. No. 07/803,236 filed Dec. 5, 1991, now U.S. Pat. No. 5,379,049 which is a continuation of application Ser. No. 07/455,869 filed Dec. 18, 1989 now U.S. Pat. No. 5,089,811, which is a continuation of application Ser. No. 07/262,176 filed Oct. 20, 1988 now abandoned, which is a continuation of application Ser. No. 07/38,476 filed Apr. 13, 1987 now abandoned, which is a continuation of Ser. No. 06/600,921 filed Apr. 16, 1984 now abandoned.

RELATED APPLICATIONS

The following of my U.S. patent applications are related to the present application and are all assigned to the same assignee and are incorporated herein by reference: A sprite collision detector; Ser. No. 45,722, filed May 1, 1987 now abandoned, a continuation of Ser. No. 600,688 filed Apr. 16, 1894 now abandoned; An advanced video processor with hardware scrolling; Ser. No. 42,551, filed Apr. 24, 1987 now abandoned, a continuation of Ser. No. 600,737 filed Apr. 16, 1984 now abandoned; An advanced video processor generator having colored text capabilities Ser. No. 600,672 filed Apr. 16, 1984 now abandoned.

BACKGROUND OF THE INVENTION

The invention relates generally to video signal devices and, more particularly, but not by way of limitation, to a video display processor which can superimpose one or more mobile patterns at selected locations on a larger, fixed pattern image and provide a wide selection for the mobile patterns or the fixed image.

The basic principal for superimposing one or more mobile patterns at selected locations on a larger, fixed pattern image was described and claimed in U.S. Pat. No. 4,243,948 assigned to the assignee of the present invention. Other systems which disclose moveable patterns are provided in the following U.S. Pat. Nos. 4,112,422; 4,129,858; 4,034,990; 4,107,664; 4,016,362; 4,116,444; 3,771,155; 4,296,476; 4,232,374; 4,177,462; and 4,119,955.

SUMMARY OF THE INVENTION

An advanced video display processor generates displays for displaying of either graphics or text information via a display monitor or a TV set operating as a monitor. A color palette is included in the advanced video processor for programming of the color of the display. The color palette provides 512 color selections, any sixteen of which may be displayed at once.

It is the object of the invention to provide an advanced video display processor that has included therein a color palette that provides 512 colors.

It is another object of the invention to provide an advanced video display processor that has included therein a color palette that allows any 16 colors of 512 to be displayed at once.

It is yet another object of the invention to provide an advanced video display processing system containing a color palette that includes up to 16 nine bit registers to select the color of a display that is provided by the advanced video display processor.

It is still yet another object of the invention to provide an advanced video display processor containing a color palette and having included therein 16 nine bit registers which are used to select the color wherein three bits control the intensity of the red gun of a display monitor, three bits control the green gun and three bits control the blue gun of a display monitor.

These and advantages of the present invention will be more apparent from a reading of the specification in conjunction with the figures in which:

BRIEF DESCRIPTION OF THE FIGURES

FIG. 5 is a diagram illustrating the use of sprites to create a graphics display;

FIG. 6 is a diagram of a sprite collision register and bit assignments of the byte according to the invention;

FIG. 9 is a bus assignment of the advance video processor's data bus;

FIGS. 10, 11*a*, 11*b*, 11*c*, 11*d*, 12, 13 and 14 are register assignment layouts;

FIG. 15 is a color assignment design;

FIG. 16 is a status bit assignment design.

DETAILED DESCRIPTION OF THE PREFERRED EMBODIMENT

Figure 1:
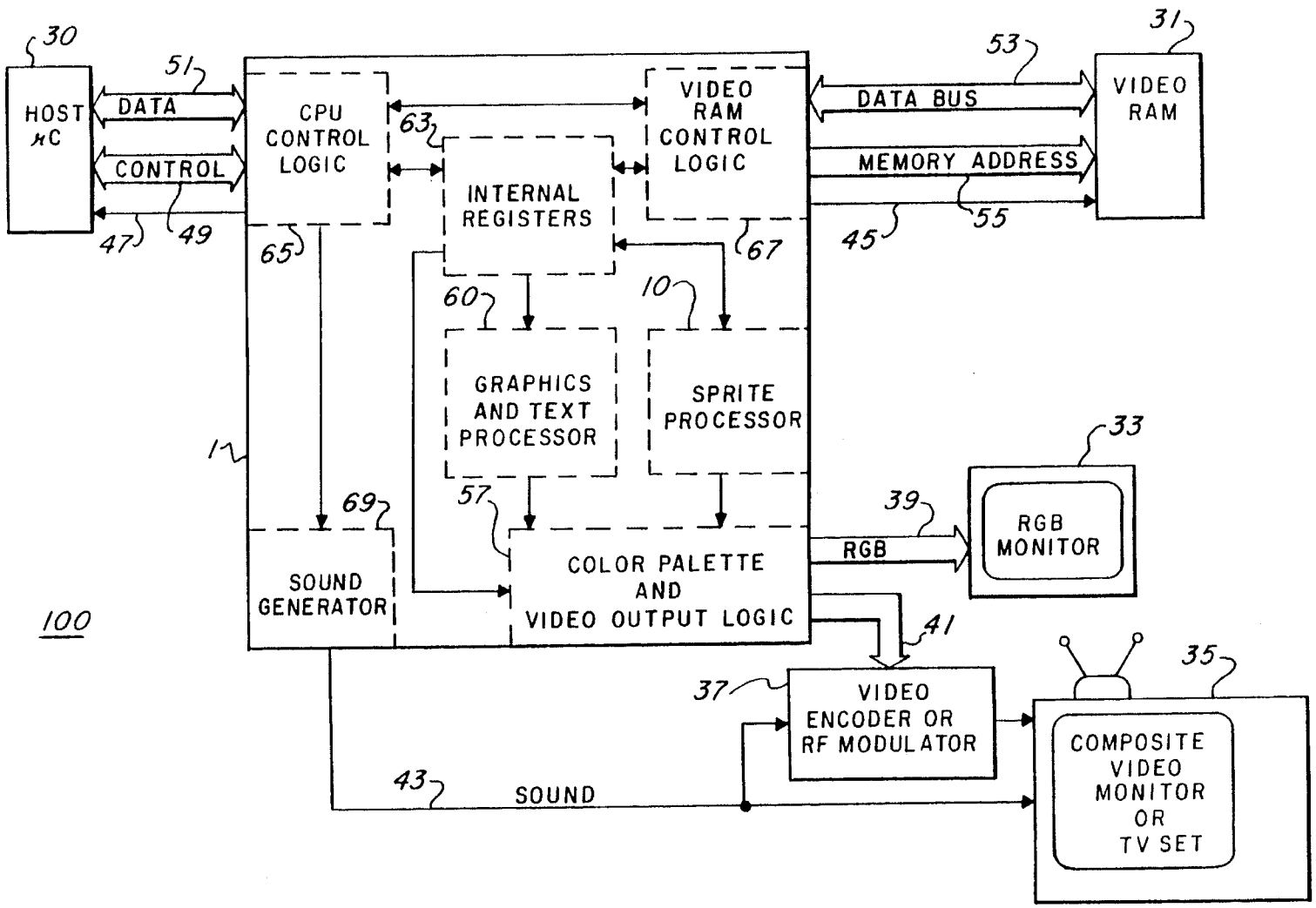
FIG. 1 is a block diagram of a video display system according to the invention.

In FIG. 1, to which reference should now be made, there is shown a block diagram of a video display system 100 incorporating an advanced video display processor 1 according to the invention. A host microcomputer 30 (CPU) interfaces with an Advance Video Display Processor (AVDP) 1 via a bidirectional data bus 51, a control bus 49 and an interrupt line 47. The AVDP 1 is used to interface microprocessor 30 to a color video monitor 33. The AVDP 1 uses a dynamic RAM 31 to store the information displayed on the video screen. The microprocessor 30 loads the AVDP's 1 configuration registers via the 8 bit CPU to AVDP data bus 51. The microprocessor 30 then loads the video RAM 31 with the information that is to be displayed on a video screen 32. The AVDP 1 refreshes the video screen 32 independently of CPU accesses. The video RAM 31 is accessed by the AVDP 1 through an 8 bit address bus 55 an 8 bit data bus 53 and control lines 45. The AVDP 1 also supplies the necessary RAS (Row Address Strobe) and CAS (Column Address Strobe) to interface the dynamic video RAM 31 to AVDP 1. Graphics are displayed on either one or two possible systems, a Red, Green, and Blue (RGB) monitor 33 which is connected to the advanced video display processor 1 via an RGB bus 39 or a composite video monitor or TV set 35 which is connected to the advanced video display processor 1 via a color difference bus 41 and a video encoder or RF monitor 37. Additionally, sound is provided to the composite video monitor or TV set 35 via a sound bus 43. The advanced video processor 1 includes 7 basic function blocks. These include the CPU control logic 65 which handles the interface between the host microcomputer 30 and the advanced video display processor 1 and is the termination portion of the control lines 49, the input and output of data to data bus 51 and provides interrupts to the host microcomputer 30 via interrupt line 47. CPU control logic 65 enables the host microcomputer 30 to conduct five basic operations. These include the writing of data into the video RAM 31, the reading of data from the video RAM 31, the writing of data to the advanced video display processor (AVDP) 1's internal registers 63, the reading of data from some of the advanced video display processor 1's internal registers 63 and the writing to an internal sound generator 69 that is contained within the advanced video display processor 1.

The type and direction of data transfers are controlled by the control lines 49 and in particular CSW, CSR, and MODE input lines. CSW is the CPU 30 to AVDP 1 write select line. When CSW is active low the eight bits on the CDO-CD7 of the advanced data lines 51 are strobed into the video display processor 1. CSR is the CPU to AVDP read select line. When CSR is active low the AVDP outputs eight bits of data onto the CDO-CD7 lines for the CPU to read. When CSW and CSR are both active low the sound generator 69 is addressed.

MODE determines the source or destination of a read or write transfer. MODE is generally connected to a CPU low order address line.

FIG. 9 provides an illustration of the data transfer between the host CPU 30 to the AVDP 1. A video RAM control logic 67 controls the interface between the advanced video display processor 1 and the video RAM 31 and handles the transfer of data from the data bus 53 that is provided to the video RAM 31 at the memory address location that is provided on the memory address bus 55 in response to the control signals that are provided on the control lines 45. In the embodiment shown, the data bus 53 is an 8 bit bidirectional bus and the memory address bus 55 is an 8 bit multiplex address bus. The advanced video display processor illustrated in FIG. 1 can directly address; 16K bytes, two TMS4416s or equivalent; 32K bytes, 4 TMS4416s or equivalent; or 65K bytes 8 TMS41664s or equivalent (all TMS parts are manufactured by Texas Instruments or equivalent) while currently providing dynamic refresh to the video RAM 31.

The internal registers 63 in the embodiment shown in FIGS. 1 and 2 contain two read only registers, a status register and a sprite collision register illustrated in FIG. 10 and forty nine write only registers illustrated in FIGS. 11*a*, 11*b*, 11*c*, and 11*d*. The write only registers provide the following functions. Three of the write only registers define the mode of operation of the advanced video display processor 1 and specify options such as the mode of operation and type of video signal output necessary to drive the RGB monitor 33 or the composite video monitor or TV set 35. Six of the write only registers that are contained within the internal register block 63 are designated by the advanced video display processor 1 to as the display memory address mapping registers and specify locations in the video RAM 31. One write only register is a color code register and defines colors when the advanced video display processor 1 is operating in the text mode. Two separate registers are scrolling registers; one is for horizontal scrolling the other is for vertical scrolling. One programmable interrupt register enables the advanced video display processor 1 to be reconfigured during a horizontal retrace interval that occurs in all television monitor signals. Four block move address and decrement counter registers allow a defined block of video memory to be moved to another video memory location. Thirty two palette pilot registers define up to 16 displayable colors (from a 52 color palette) per horizontal scan lines.

The read only registers provide the following functions. A status register contains flags for interrupts, coincidence and eleventh sprite occurrence on any one horizontal line. The AVDP has a single 8-bit status register 28 which can be read by the CPU 1. The format of the status register 28 is shown in FIG. 12. The status register contains the interrupt pending flag (F), the sprite coincidence flag (C), the eleventh sprite flag (11S), and the eleventh sprite number if one exists.

The status register 28 may be read at, any time to test the F,C and 11S status bits. Reading the status will clear the interrupt flag F. However, asynchronous reads of the status will cause the frame flag (F) bit to be reset and therefore possibly missed. Therefore the status register should only be read when the AVDP 1 interrupt is pending. It requires only one data transfer to read the status register 28.

Interrupt Pending Flag (F)

The F status flag in the status register 28 is set to 1 whenever there is an interrupt pending. This bit will be set one of three ways; when a block move has completed, when a programmable interrupt is selected, or when an end of frame has occurred (Vertical Retrace Period). The interrupt pending flag is reset to 0 when the status register is read or by the external reset.

When the appropriate interrupt enable bit (IE bit 2 of write only register 1 or PIE bit 2 of write only register 10) is set to 1 (INT) will be active low whenever the F status flag is a logic 1.

Note the status register needs to be read after each interrupt in order to clear the interrupt and receive the new interrupt on the next occurrence.

Coincidence Flag (C)

The C status flag in the status register is set to a 1 if two or more sprites coincide. Coincidence occurs if any two sprites on the screen have one overlapping pixel. Transparent colored sprites, as well as those that are partially or completely off the screen, are also considered. The C flag is cleared to a 0 after the status register is read or the AVDP is externally reset. The status register 28 should be read immediately upon power up to ensure that the coincidence flag is reset.

The AVDP 1 checks each pixel position for coincidence during the generation of the pixel regardless of where it is located on the screen. This occurs every 1/60th of a second. Therefore when moving more than one pixel position during these intervals it is possible for the sprites to have multiple pixels overlapping or even to have passed completely over one another when the AVDP 1 checks for coincidence.

Eleventh Sprite Flag (11S) and Number

The 11S status flag in the status register is set to a 1 whenever there are 11 or more sprites on a horizontal line (lines 0 to 209 depending on the mode chosen) and the frame flag (F) is equal to 0. The 11S status flag is cleared to a 0 after the status register is read or the AVDP is externally reset. The number of the 11th sprite is placed into the lower 5 bits of the status register when the 11S flag is set and is valid whenever the 11S flag is 1. The setting of the 11th sprite flag will not cause an interrupt.

A sprite collision detection register defines which group or groups of sprites have collided.

A sprite collision coincidence register 83 illustrated in FIG. 12 is an 8 bit register that can be used to determine which groups of sprites collided. The sprite color byte is composed of 4 color bits, an early clock bit and 3 remaining bits; these 3 remaining bits are used to divide the sprites into eight groups. Each bit in the sprite collision register 83 corresponds to one group. Therefore, whenever 2 sprites collide one or more of these bits are set. This register is cleared by a CPU read to this register. FIG. 6 shows the layout of these groups in the sprite collision register 83. It requires 3 data transfers to read this register.

A sprite processor 10 incorporates full sprite control on the advanced video display processor 1 which in the embodiment shown is on a single chip. The sprite processor 10 includes the features which with as many as 10 sprites may occur (in the embodiment shown in FIG. 1) on a single horizontal scan line. Previous video display processors were limited to only four sprites per line. The sprites may be multi-color or single color with each horizontal half scan line of the sprite having the option of being a different color from the sprite. Additionally, unique sprite coincident detection is provided. A coincidence occurs if any two sprites on the display have at least one overlapping pixel. Sprite mapping necessary to provide this feature is contained in the video RAM 31.

Graphics and text processing is provided by a graphics and text processor 60 in which the host microprocessor 30 configures the advanced video display processor 1 to operate in one of the following display modes in the embodiment shown in FIG. 1:

A first graphic display mode provides resolution with two colors for each of an 8×8 pixel block in a 256×192 pixels display;

Graphics 2 mode provides two colors for each 8×1 pixel block in a 256×192 pixel display;

Graphics 3 mode provides two colors for each 4×2 pixel blocks for a 256×192 pixel display;

Graphics 4 mode provides high resolution with two colors for each 8×1 pixel block in a 512×192 total pixel resolution; and Graphics 5 mode provides a full bit map of 256×210 pixel resolutions;

A first text mode provides 40 columns by 24 rows of text; and

A second text mode provides 80 columns×24 rows of text. All text and graphics modes with the exception of the full bit map mode designated as graphics 5 are table driven.

A sound generator 69 provides in the embodiment shown in FIG. 1 on chip sound generation that is compatible with the devices such as an SN764889 device manufactured by Texas Instruments Incorporated. The circuit provides 3 programmable tone generators; one programmable noise generator; a 120 to 100,000 Hz frequency response and 15 programmable attenuation steps from 2 dB to 28 dB in steps of 2 dB.

Figure 2A:
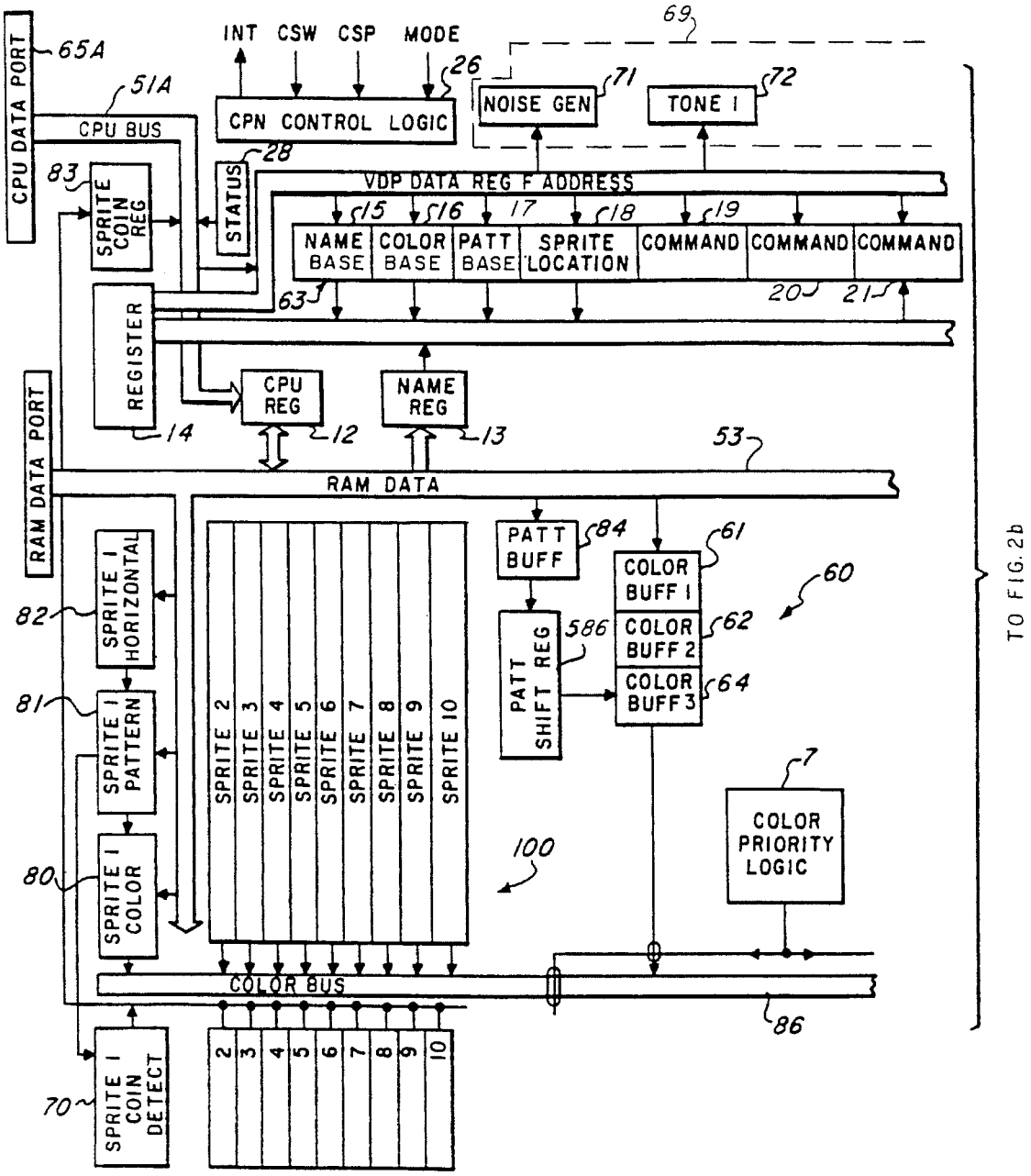
FIG. 2 is a block diagram of the advance video processor of FIG. 1.
Figure 2B:
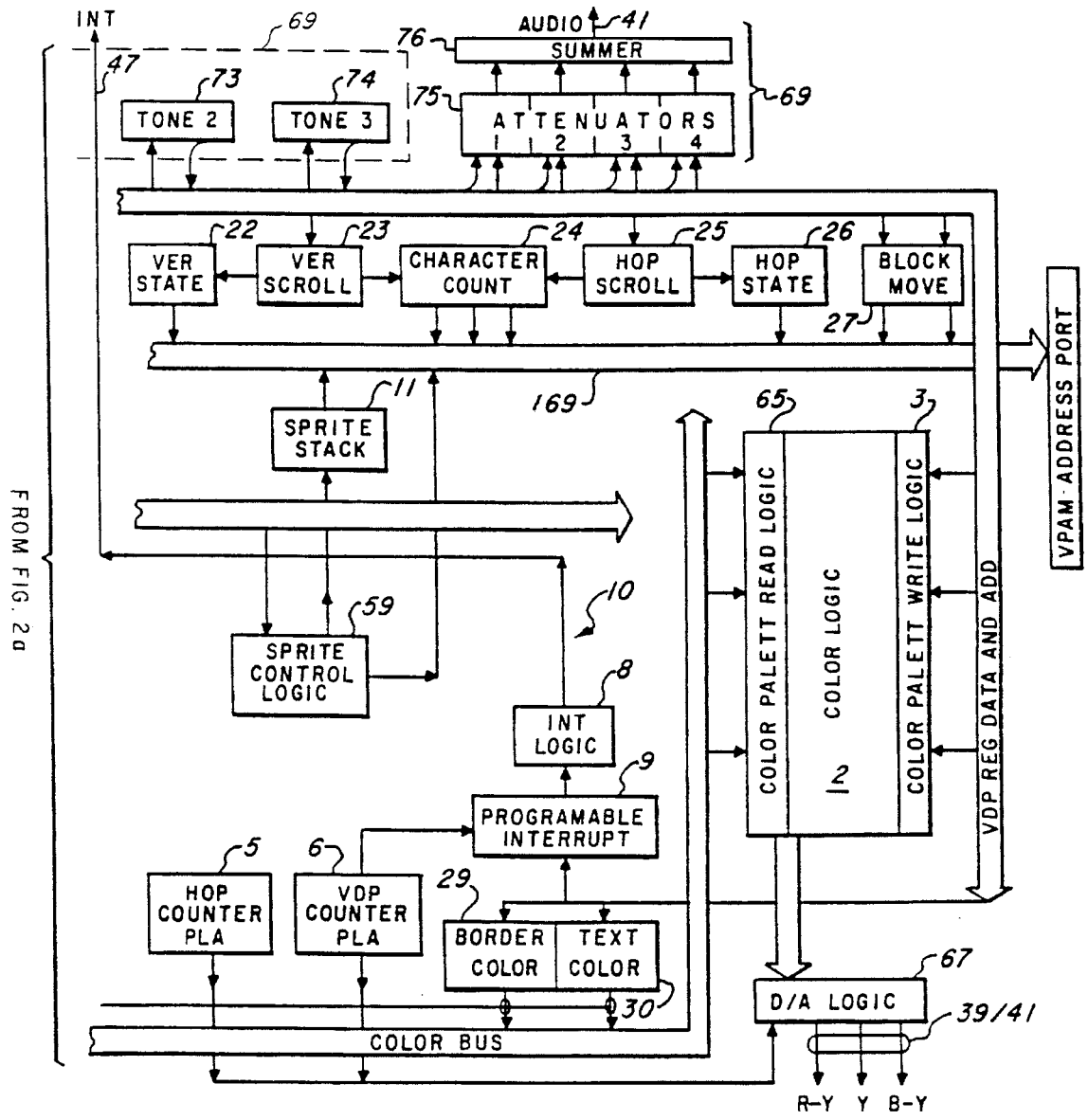
Figure 3:
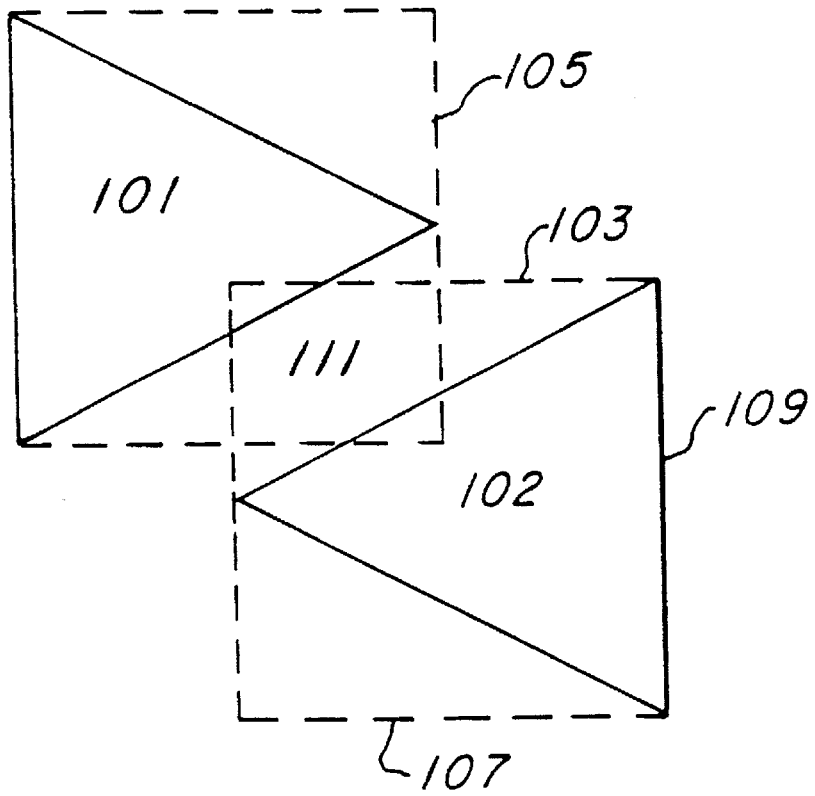
FIG. 3 is a diagram illustrating the approaching coincidence of two sprites.

FIGS. 2*a* and 2*b*, to which reference should now be made, are block diagrams of the advanced video display processor 1 of FIG. 1. As was discussed earlier in conjunction with FIG. 1, there are included in the internal registers 63 two read-only registers and forty nine write-only registers. Included in these are color palette registers 2 which are 16 registers of 9 bits each for 16 colors. The color palette registers 2 are addressed by a sprite control logic 59; a first color buffer 61; a second color buffer 62 and a third color buffer 64 which are a part of the graphics and text processor 60; a border color register 29; and a text color register 32 which provide program colors.

It should be noted that in the advanced video display processor 1 the embodiments of FIGS. 1 and 2 does not fetch color for each character in the text mode as it does in the graphics mode. A color palette read logic 65 addresses the color palette registers 2 to place the contents contained within the color palette registers on a D-to-A logic 67 which as was discussed in conjunction with the color palette and video output logic 57 of FIG. 1, provides the Red, Green and Blue colors to either the RGB monitor 33 or the different signal to the video encoded RF modulator 37. Depending on the configuration of the advanced video display processor 1, the output of the D-to-A logic 67 is placed on either the RGB bus 39 or the different color bus 41.

A color palette write logic 3 controls the loading of the color codes into the color palette register 2 which includes registers R32 through R63 of FIG. 11. The format for the palette is shown in FIGS. 13 and 14. The palette consists of sixteen 9 bit registers which allows the user to display 16 of 512 colors on the screen at one time. On an external reset the color palette is initiallized with the default values shown in FIG. 15 for the color difference outputs.

A horizontal counter, Programmable Logic Array (PLA) 5, counts positions on the horizontal scan lines and decodes instructions based upon the beam position of the scan and provides timing to the D-to A control logic 67 which is used to identify the sprite position and color. The vertical counter PEA 6 counts rows positions on the scan lines, decodes instructions and provides timing to the sprite stack 11 as does horizontal counter PLA as to position color data. Not shown in FIG. 2 is the fact that the horizontal counter PLA 5, and vertical counter PLA 6 are connected to the following logic functions.

A color priority logic 7 decides priority of color logics between border color logic 29, text color logic 32, color buffers logic 61, and 64 and sprite control logic 59. The priority is based first on border, then on sprite when in active area, or other sprites and there are three or more dependent colors and 7 modes of operations by which the color priority logic provides the appropriate color for the advance video display processor 1.

A interrupt logic 8 provides interrupt to the host CPU 30 that is based upon a timing signal interrupt to load one of the registers. Refer to FIG. 16 wherein:

IE=INTERRUPT ENABLE BIT 2 OF REGISTER 28.

F=INTERRUPT FRAME FLAG BIT 0 OF STATUS REGISTER; and

PIE=PROGRAMMABLE INTERRUPT ENABLE BIT 2 OF REGISTER 10

A programmable interrupt logic 9 provides an interrupt for any horizontal scan or line and in the embodiment shown in FIG. 1 and includes an eight bit register the contents of which are compared with the contents of the vertical counter PLA 6 and provides an interrupt request to the interrupt logic 8 when the comparison between the contents of the two registers indicates that that scan line requires an interrupt in the program sequences being executed by the host CPU 30.

The sprite control logic 59 controls the sprite fetch sequence checks vertical position from the vertical counter PLA 6 and causes the sprite horizontal position, pattern and color data to be fetched.

The sprite control logic 59 processes and checks all of the sprites which in the embodiment of FIG. 1 includes 32 sprites to see if their positions are valid. If a sprite is to be loaded on the next scan line, the sprite control logic 59 loads the sprite number or vertical position into a sprite stack 11. The sprite stack 11 places the address of the sprite on the RAM address bus 169 for retrieval from the video RAM 31.

A CPU register 12 interfaces the host microcomputer 30 with the video RAM 31 via the data bus 51 and 51A which is contained within the advanced video display processor 1. A name register 13 contains the name of the background pattern (an 8 bit number) which is used to fetch the pattern and color bytes for the next character to be displayed. An address register 14 addresses the video RAM 31 based upon the host microprocessor 30 instructions (whether the instruction is a read or a write instruction) and also addresses the advanced video display processor 1, internal registers 63 and color palette registers 2.

The scroll logic includes a vertical state register 22, vertical scroll register 23, character counter 24, horizontal scroll register 25, and horizontal state register 26.

For graphics modes 1,2,3,4 and text modes 1 and 2, the screen is broken up into characters. The character counter 24 counts the characters as the TV scans horizontally and vertically. The horizontal state register 26 determines which pixel of the character is being displayed. The vertical state counter 22 determines which row of the character is being displayed.

Graphics mode 5 is bit mapped and is not broken up into characters. The horizontal state 26, vertical state 22, and character counter 24 will count pixel by pixel as the TV scans horizontally and vertically in this mode. These counters are used to address the video RAM 31. The horizontal scroll register 25 contains an 8 bit number which determines the horizontal scroll location on the screen. At the beginning of each horizontal line the contents of the horizontal scroll register 25 is loaded into the horizontal state register 26 and character counter 24. By changing the starting position of the counters the screen can be scrolled up to 256 different horizontal positions.

The vertical scroll register 23 contains an 8 bit number which determines the vertical scrolling of the screen. At the beginning of each screen scan, the vertical scroll register 23 is loaded into the vertical state register 22 and the character counter 24. By changing the starting position of the counters the screen can be scrolled up to 256 different vertical positions.

The base registers 15, 16, 17, 18 define the locations in video memory 31 where the sections of video information will be stored. The name base register 15 defines the location of the name table in memory. The color base register 16 defines the location of the video color information. The pattern base register 17 defines the location of the pattern bits used to map each character. The sprite location register 18 defines the location of the sprite patterns, sprite colors, sprite horizontal position, and sprite vertical position. The command registers 19, 20, 21 control the mode of operation of the advanced video display processor 1.

A status register 28 provides status via data bus 51A to the host microcomputer 30 that reflects the following interrupt information; a programmable interrupt has occurred; more than 10 sprites are being used; two sprites collide; and five additional status bits for the 11th sprite on a line. The CPU control logic 65 provides interrupts to the host microcomputer 30 and receives the write commands, the read commands, and mode commands indicating operation; if writing or reading to the video internal registers 63 or video RAMs 31.

The block movie registers 27 two 16 bit registers are used to move data from one section of memory to another section of memory. One register contains the number of bytes to be moved; the other register contains the read memory location. The write memory destination is located in the address register 14.

The color buffers 60 contain 3 bytes of pattern plane color information. Buffer 64 contains the colors which are ready to be loaded onto the color Buss 86. This buffer contains 1 byte of information or (2) 4 bit colors. For graphics modes 1,2,3,4 the LSB nibble of the color byte is loaded onto the color buss if the pattern bit=1 and the MS nibble of the color byte is loaded onto the color buss if the pattern bit=0. For graphics (5), (the bits mapped mode) the LSB nibble is the first color pixel to be displayed and the MSB nibble is the second color pixel to be displayed. Buffers 61 and 62 are temporary storage buffers which will be loaded into buffer 64.

The pattern buffer 84 contains the 1's and 0's which will determine which color in buffer 64 will be displayed. The pattern buffer 84 is loaded into the pattern shift register 586 and shifted out serially. The output of the shift register 586 loads the colors from buffer 64 onto the color buss 86 depending on the color priority logic.

The sprite registers 100 contain the sprite horizontal pointer 82, the sprite pattern register 81, the sprite color register 80, and the sprite coincidence selection logic 70. This is repeated 10 times for 10 sprites per horizontal line. The sprite horizontal pointer 82 is loaded with the horizontal sprite position and decrements to the value of zero. Then the sprite pattern register 81 begins shifting bits out serially. 1's load this sprite color onto the color buss 86 and 0's are not used.

The sprite color register 80 contains 4 bits for the sprite color, 1 bit for early clock, and 3 bits to indicate the sprite group.

The sprite coincidence detection logic 70 determines if two or more sprites are shifting 1's out of the sprite pattern register 81 at the same time. If this happens 2 or more sprites have collided on the screen. The sprite groups are decoded from the three bits stored in the 10 sprite color registers 80, and the bits corresponding to the sprite groups are set in the sprite coincidence register 83. If the sprites are in the border areas they will not be displayed, the bits will not be set. The three bits in the sprite color register 80 can be decoded into 8 groups, each group corresponds to a bit in the sprite coincidence register 83.

Figure 4:
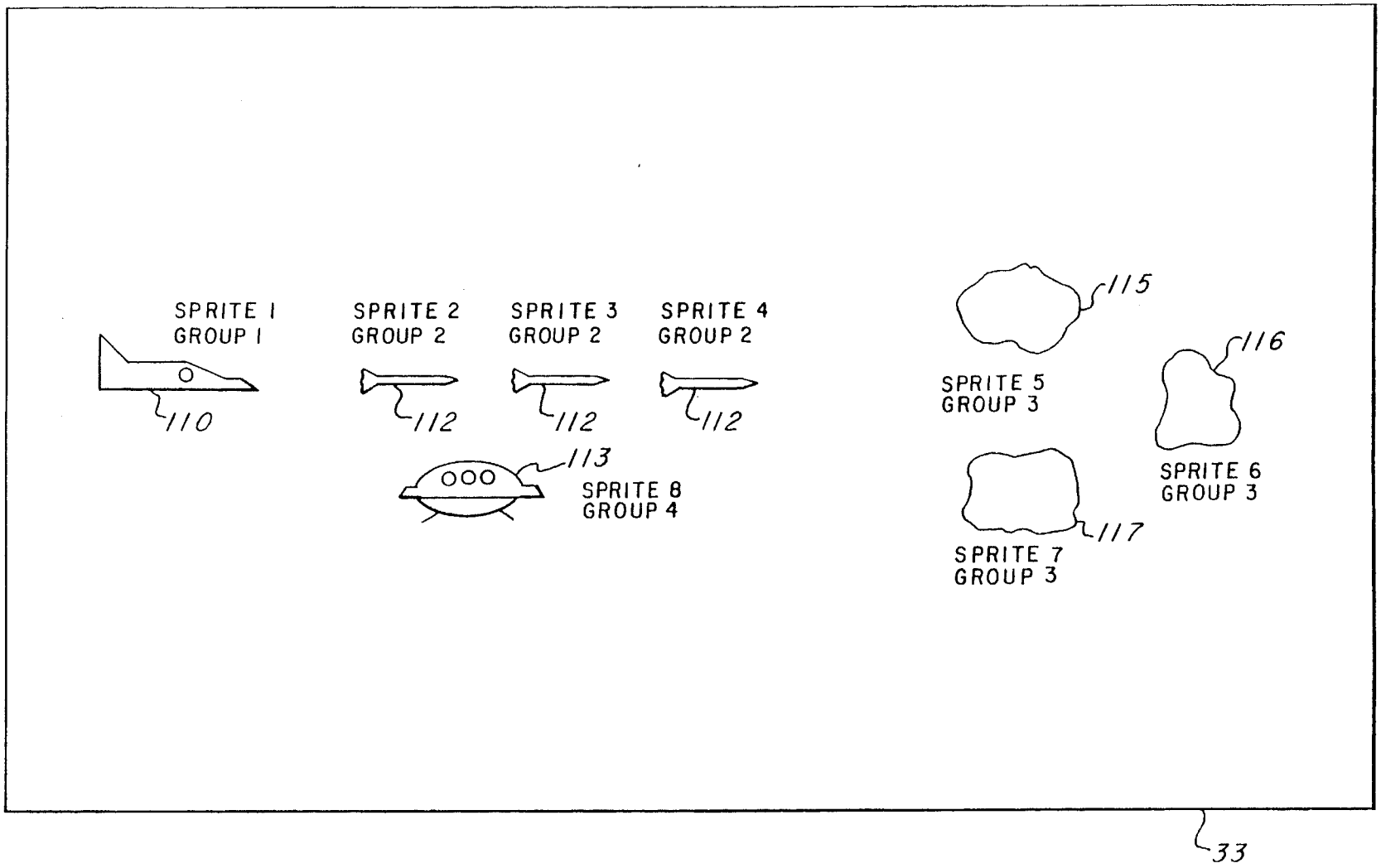
FIG. 4 is a diagram indicating the use of sprites for a computer game.

Referring to FIG. 4, the coincidence detector of FIGS. 1 and 2 is useful in the application of the invention to video games; for example a space game in which a space ship 110 which is defined as sprite 1 belonging to group 1, and a plurality of rocket ships which are defined as sprites 2, 3 and 4, all assigned to group 2, a flying saucer 13 which is sprite 8 of group 4 and a plurality of meteors 115, 116 and 117 all are sprites belonging to group 3 are used to implement the game. If one of the rocket ships 112 a, b or c which are in group 2 collide with one another, a coincidence will be detected and bit 2 of the sprite coincidence register 53 will be set. If the spaceship 110 collides with one of the missiles 112, a coincidence will be detected, and bits 1 and 2 of the sprite coincidence register 83 will be set. The host CPU 30 can check to see if the spaceship 10 has collided with another object by reading the sprite coincidence register 83 and checking bit 1.

FIG. 5 demonstrates multicolor sprites. Sprites can have a different color on each horizontal line. Sprite (1) which contains the hat, eyes, nose, and mouth is only one sprite, even though there are four different colors. Sprite (2) is the face of the sprite and has to be drawn as a separate sprite since it is on the same horizontal lines as the eyes, nose, and mouth. When sprite 1 and sprite 2 are combined together the sprite 129 is created.

Figure 7:
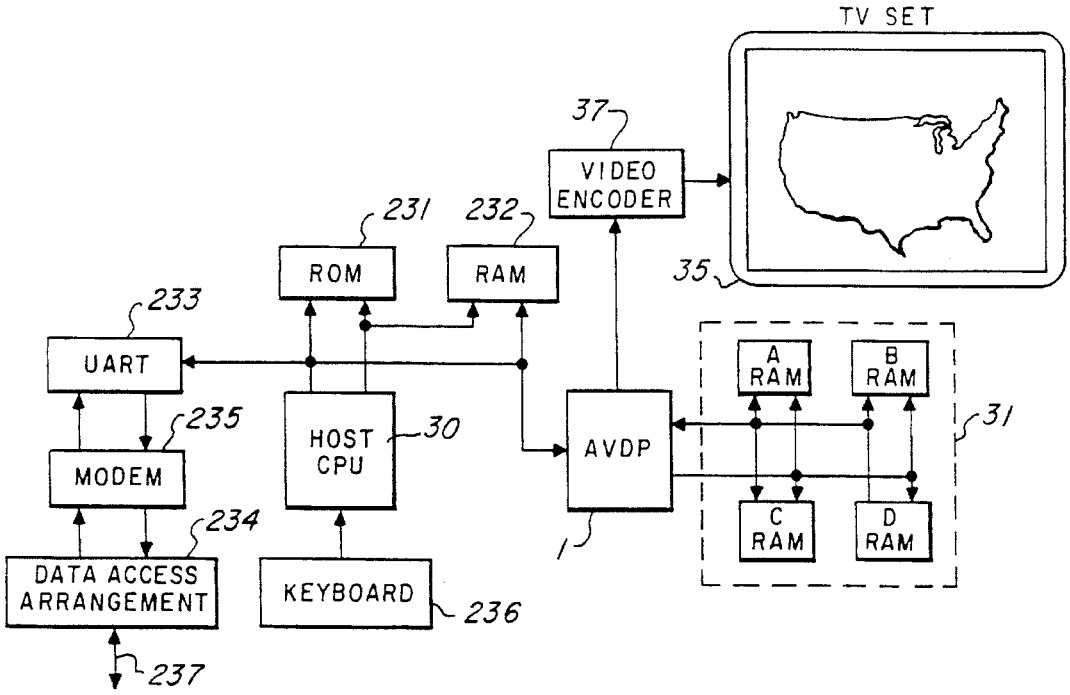
FIG. 7 is a block diagram of an alternate embodiment of the invention.

FIG. 7 illustrates combining the necessary processing steps on a single chip that allows both graphics and alphanumeric data (video-text) to be generated. In FIG. 7, two way communication is provided in a video text example over standard lines 237 using a modem 235, a data access arrangement 234, and a UART 233. The host CPU 30 has additional interface to a ROM memory 231 and a RAM memory 232, as well as operator interface by a keyboard 236. The Advanced Video Data Processor 1 is connected to four RAM's that represent the video RAM 31, and includes an A RAM, B RAM, C RAM, and D RAM as illustrated in FIG. 7. The use of the four RAMs which in the preferred embodiment are TMS44116s manufactured by Texas Instruments, provides the memory necessary for the video data storage. The video data is sequenced out by the advanced video display processor 1 and then encoded by the video encoder 37 to dot data for each horizontal scan line. The information can then be viewed on the TV set 35. The advanced video display processor 1 provides all the video information and synchronization required to refresh and display the images on the TV set 35.

Figure 8:
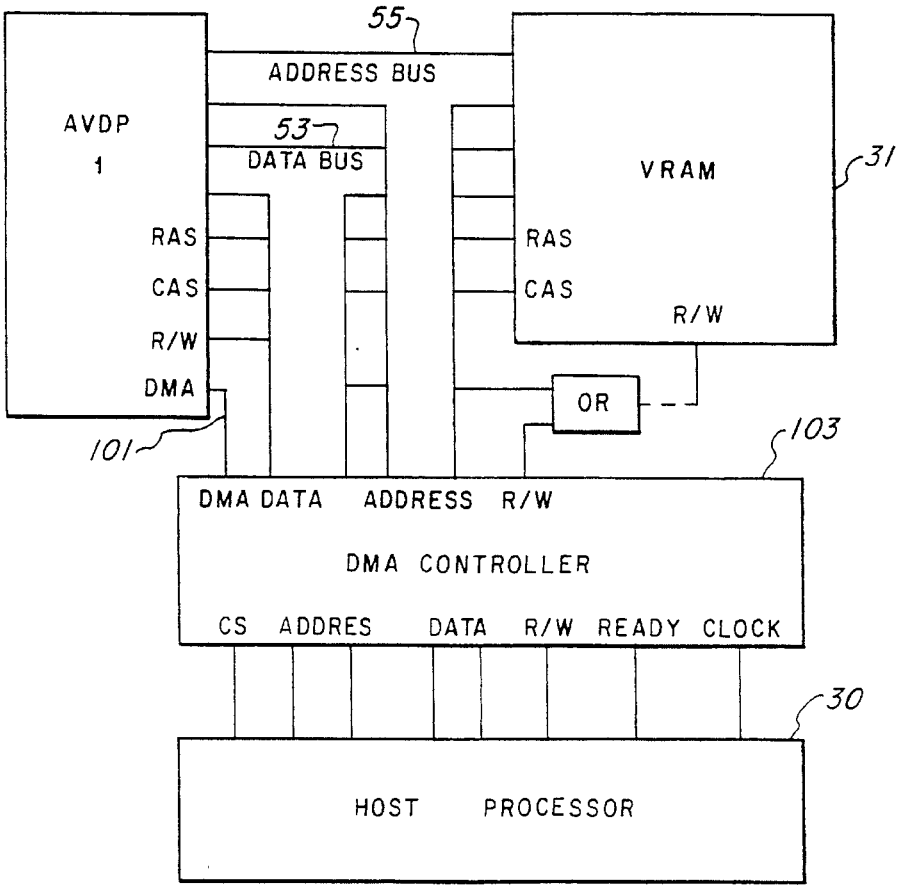
FIG. 8 is a block diagram illustrating the use of a direct memory address capabilities of the advance video processor according to the invention.

In FIG. 8, to which reference should now be made there is shown the Direct Memory Access (DMA) via a DMA controller 103 and a DMA pin 101 which allows the host microcomputer 30 to directly access the video RAM 31. This pin goes to a logic '1' when there is no CPU access.

Thus, although the best modes contemplated for carrying out the present invention have been herein shown and described, it will be apparent that modification and variation may be made without departing from what is regarded as the subject matter of the invention.

What is claimed is:

1. A video display processor comprising:

a memory port for reading and writing a plurality of display data consisting of individual display pixels from an external memory;

a horizontal scroll register for storing a horizontal base address;

a horizontal state counter/register connected to said horizontal scroll register, said horizontal state counter/register loaded from said horizontal scroll register at the beginning of each horizontal line of a raster scan display and thereafter counting for each pixel of the horizontal line of the raster scan display;

a vertical scroll register for storing a vertical base address;

a vertical state counter/register connected to said vertical scroll register, said vertical state counter/register loaded from said vertical scroll register at the beginning of each screen of the raster scan display and thereafter counting for each horizontal line of the raster scan display;

an address bus connected to said memory port, said horizontal state counter/register and said vertical state counter/register, said address bus supplying addresses to said memory port corresponding to a current state of said horizontal state counter/register and said vertical state counter/register;

a data bus connected to said memory port for receiving display data consisting of display pixels recalled from the external memory via said memory port; and a video output logic connected to said data bus for converting display data consisting of display pixels received from said data bus to video display signals.

2. The video display processor of claim 1, further comprising:

an external processor port connected to said horizontal scrolling register, said external processor port permitting an external processor to load said horizontal base address into said horizontal scrolling register.

3. The video display processor of claim 1, further comprising:

an external processor port connected to said vertical scrolling register, said external processor port permitting an external processor to load said vertical base address into said vertical scrolling register.

4. The video display processor of claim 1, further comprising:

an external processor port connected to said horizontal scrolling register and said vertical scrolling register, said external processor port permitting an external processor to load said horizontal base address into said horizontal scrolling register and to load said vertical base address into said vertical scrolling register.

5. The video display processor of claim 1, wherein:

said display data recalled from the external memory by said video display processor consists of color data indicative of a color to be displayed for a single pixel.

6. The video display processor of claim 1, further comprising:

at least one sprite register storing a sprite horizontal location and sprite color data for a corresponding mobile pattern of a predetermined size in pixels smaller than said video display, said at least one sprite register outputting said sprite color data when said raster scan of said video display has a horizontal location including said corresponding mobile pattern;

a color priority logic connected to said data bus, said video output logic and said at least one sprite register, said color priority logic supplying said color data from said data bus to said video output logic when none of said at least one sprite register outputs sprite color data and supplying said sprite color data from a sprite register having a highest priority in a predetermined priority of sprites to said video output logic when any of said at least one sprite register outputs sprite color data.

7. The video display processor of claim 6, wherein:

data corresponding to a sprite horizontal location, a sprite vertical location, sprite color data and sprite group data for each mobile pattern are stored in the external memory; and said video display processor further comprises a sprite control logic connected to said memory port and said at least one sprite register for determining if a next horizontal line of said raster scan of said video display includes any mobile pattern and for reading a sprite horizontal location and sprite color data for each such mobile pattern from the external memory via said memory port and storing said read sprite horizontal location and said read sprite color data in a corresponding sprite register.

8. The video display processor of claim 6, further comprising:

a color palette connected to said color priority logic, said color palette including an input receiving color data output from said color priority logic, a plurality of color palette registers each storing a color code wherein the number of colors specifiable by said color codes exceed the number of said color palette registers and an output, said color palette outputting a color code via said output corresponding to color data received at said input; and a digital to analog converter having an input connected to said output of said color palette and an output, said digital to analog converter outputting at least one analog color signal corresponding to color codes received at said input.

9. The video display processor of claim 8, further comprising:

an external processor port connected to said color palette registers, said external processor port permitting an external processor to write color codes into each of said color palette registers.

10. A video display system comprising:

a host processor;

a memory for storing display data consisting of display pixels;

a video display processor disposed on a single integrated circuit including a memory port for reading and writing a plurality of display data consisting of display pixels from an external memory, a horizontal scroll register for storing a horizontal base address, a horizontal state counter/register connected to said horizontal scroll register, said horizontal state counter/register loaded from said horizontal scroll register at the beginning of each horizontal line of a raster scan display and thereafter counting for each pixel of the horizontal line of the raster scan display, a vertical scroll register for storing a vertical base address, a vertical state counter/register ,connected to said vertical scroll register, said vertical state counter/register loaded from said vertical scroll register at the beginning of each screen of the raster scan display and thereafter counting for each horizontal line of the raster scan display, an address bus connected to said memory port, said horizontal state counter/register and said vertical state counter/register, said address bus supplying addresses to said memory port corresponding to a current state of said horizontal state counter/register and said vertical state counter/register, a data bus connected to said memory port for receiving display data consisting of display pixels recalled from said memory via said memory port, a video output logic connected to said data bus for converting display data consisting of display pixels received from said data bus to video display signals, and a host processor port connected to said host processor, said horizontal scrolling register and said vertical scrolling register, said host processor port permitting said host processor to load said horizontal base address into said horizontal scrolling register and to load said vertical base address into said vertical scrolling register; and a video display connected to said video output logic for generating a visual display corresponding to said video display signals output by said video output logic.

11. The video display system of claim 10, wherein:

said display data stored in said memory consists of color data indicative of a color to be displayed for a single pixel.

12. The video display system of claim 11, wherein:

said video display processor further includes at least one sprite register storing a sprite horizontal location and sprite color data for a corresponding mobile pattern of a predetermined size in pixels smaller than said video display, said at least one sprite register outputting said sprite color data when said raster scan of said video display has a horizontal location including said corresponding mobile pattern, and a color priority logic connected to said data bus, said video output logic and said at least one sprite register, said color priority logic supplying said color data from said data bus to said video output logic when none of said at least one sprite register outputs sprite color data and supplying said sprite color data from a sprite register having a highest priority in a predetermined priority of sprites to said video output logic when any of said at least one sprite register outputs sprite color data.

13. The video display system of claim 12, wherein:

data corresponding to a sprite horizontal location, a sprite vertical location, sprite color data and sprite group data for each mobile pattern are stored in said memory; and said video display processor further includes a sprite control logic connected to said memory port and said at least one sprite register for determining if a next horizontal line of said raster scan of said video display includes any mobile pattern and for reading a sprite horizontal location and sprite color data for each such mobile pattern from said memory via said memory port and storing said read sprite horizontal location and said read sprite color data in a corresponding sprite register.

14. The video display system of claim 12, wherein:

said video display processor further includes a color palette connected to said color priority logic, said color palette including an input receiving color data output from said color priority logic, a plurality of color palette registers each storing a color code wherein the number of colors specifiable by said color codes exceed the number of said color palette registers and an output, said color palette outputting a color code via said output corresponding to color data received at said input, and a digital to analog converter having an input connected to said output of said color palette and an output, said digital to analog converter outputting at least one analog color signal corresponding to color codes received at said input.

15. The video display system of claim 14, wherein:

said host processor port further is connected to said color palette registers permitting said host processor to write color codes into each of said color palette registers.

* * * * *